US005133305A

United States Patent [19]

Tanigawa et al.

[11] Patent Number: 5,133,305

[45] Date of Patent: Jul. 28, 1992

[54] INTERNAL COMBUSTION ENGINE HAVING ROTARY ENGINE BODY

[76] Inventors: Hiroyasu Tanigawa; Kazunaga Tanigawa; Yukinaga Tanigawa, all of 428-35, Enami, Okayama-shi, Okayama-ken, Japan

[21] Appl. No.: 645,791

[22] Filed: Jan. 25, 1991

[30] Foreign Application Priority Data

Feb. 2, 1990 [JP] Japan ..... 2-23975

[51] Int. Cl.[5] ..... F02B 57/06; F02B 75/26

[52] U.S. Cl. ..... 123/45 A; 60/624; 123/56 C; 123/74 R

[58] Field of Search ..... 60/624; 123/45 R, 45 A, 123/51 B, 51 BA, 56 C, 74 R, 74 B

[56] References Cited

U.S. PATENT DOCUMENTS 648,914 5/1900 Bertheau ..... 123/74 B
3,994,632 11/1976 Schreiber ..... 123/45 A X

FOREIGN PATENT DOCUMENTS 135326 8/1953 Japan ..... 123/45 A
119930 7/1983 Japan ..... 123/45 A
200036 11/1983 Japan ..... 123/45 A
39932 3/1984 Japan ..... 123/45 A
79821 4/1986 Japan ..... 123/45 A
79822 4/1986 Japan ..... 123/45 A
31761 2/1990 Japan ..... 123/45 A
35841 2/1990 Japan ..... 123/45 A
34908 1/1912 Sweden ..... 60/624

*Primary Examiner*—Michael Koczo
*Attorney, Agent, or Firm*—Marks & Murase

[57] ABSTRACT

The present invention provides an internal combustion engine comprising a hollow engine body rotatable about a fixed shaft, a pair of pistons capable of rotating with but slidably reciprocating relative to the engine body, and a cam mechanism for causing each piston to make one full rotation with the engine body as the piston makes two reciprocations. A combustion chamber is formed in the engine body between the pair of pistons, whereas a pair of air supply chambers are arranged on the side of the respective pistons axially away from the combustion chamber. Each air supply chamber is highly compressed when the pistons are moved away from each other, and the resulting compressed air is utilized for scavenging, internally cooling and supercharging the combustion chamber.

20 Claims, 8 Drawing Sheets

INTERNAL COMBUSTION ENGINE HAVING ROTARY ENGINE BODY

BACKGROUND OF THE INVENTION

1. Field of the Invention

This invention relates generally to internal combustion engines. More particularly, the invention relates to an internal combustion engine of the type wherein an engine body itself is rotated to drive an output shaft.

2. Description of the Prior Art

As is well known, most of the conventional internal combustion engines equally incorporate a crank mechanism for converting piston reciprocation into rotation of the output shaft. Such a crank mechanism has been found to result in a non-negligible energy loss.

In view of the above problem, Japanese Patent Publication No. 2-31761 (Published: Jul. 16, 1990; Laid-open: Jun. 11, 1983), which was filed by one of the inventors of the present invention, discloses an internal combustion engine in which a pair of pistons are made to rotate with a cylindrical engine body as the pistons reciprocate in response to explosive combustion occurring in a combustion chamber between the pistons. The rotation of the engine body is directly transmitted to an output shaft without requiring a crank mechanism.

Specifically, the engine body disclosed in the above Japanese patent publication is rotatably received in a pair of cam cylinders, and has two pairs of longitudinal guide slots. The respective pistons have guide projections slidably guided by the longitudinal guide slots of the engine body, so that the pistons are rotatable with but slidably reciprocatable relative to the engine body. Each cam cylinder is internally formed with a curved cam groove, whereas each piston carries a pair of piston pins penetrating through the longitudinal guide slots to fit into the cam groove. The cam groove have such a profile that the piston makes one full rotation with the engine body as the piston makes two reciprocations.

Obviously, the engine described above requires no crank mechanism, and therefore has an advantage of being higher in energy efficiency than the conventional reciprocating engines. Further, the rotation of the engine body causes air within the combustion chamber to rotate, so that the air can be forcibly and uniformly mixed with the fuel to provide an enhanced combustion efficiency.

A similar internal combustion engine is also disclosed in Japanese Patent Publication No. 2-35841 (Published: Aug. 14, 1990; Laid-open: Jul. 21, 1983) which was also filed by one of the inventors of the present invention.

According to either of the two Japanese patent publications, a chamber lid is attached to each end of the engine body to define an air supply chamber extending into the hollow interior space of the corresponding piston from the side thereof axially away from the combustion chamber. The air supply chamber is compressed when the piston moves toward the chamber lid, namely toward the lower deadpoint. The air thus compressed within the air supply chamber is introduced into the combustion chamber for scavenging and for performing air supply for combustion.

Obviously, it is preferable that the air supply chamber is compressed to a high extent for effectively scavenging the combustion chamber and for increasing the combustion efficiency. However, the chamber lid of the prior art is not fully insertable into the piston at the lower deadpoint thereof, so that the air supply chamber is compressed only to a limited degree.

SUMMARY OF THE INVENTION

It is, therefore, a primary object of the present invention to provide an internal combustion engine which has a rotary engine body, and wherein air can be highly compressed by piston reciprocation and thereafter introduced into the combustion chamber.

Another object of the present invention is to provide an internal combustion engine which has a rotary engine body, and which is capable of effectively recovering the heat and flow energy of exhaust gas for assisting rotating of the engine body.

A further object of the present invention is to provide an internal combustion engine which has a rotary engine body, and which ensures smooth piston reciprocation.

Still another object of the present invention is provide an internal combustion engine which has a rotary engine body, and which incorporates an improved fuel injection device.

According to the present invention, there is provided an internal combustion engine comprising: an engine body having a piston housing bore; an axially opposed pair of pistons disposed within the bore of the engine body to define a combustion chamber between the pair of pistons, the respective pistons being rotatable with the engine body but slidably reciprocatable between upper and lower deadpoints relative to the engine body, each piston carrying cam follower means extending transversely through the engine body; hollow cam carrier means rotatably receiving the engine body, the cam carrier means internally having a pair of curved cam grooves each receiving the cam follower means of the corresponding piston for causing the piston to make one full rotation with the engine body as the piston makes two reciprocations; a pair of chamber lids each mounted to the engine body for rotation therewith and defining an air supply chamber extending into the corresponding piston from the side thereof axially away from the combustion chamber, each lid having an extension which is insertable substantially fully into the piston when the piston moves to the lower deadpoint; fuel injection means for injecting a fuel into the combustion chamber; air entry means for supplying compressed air from the air supply chamber into the combustion chamber as the respective pistons approach the lower deadpoint; and air exhaust means for allowing exit of exhaust gas from the combustion chamber as the respective pistons approach the lower deadpoint.

According to the arrangement described above, the extension of each chamber lid is fully insertable into the corresponding piston to enable high compression of the corresponding air supply chamber. The air thus compressed within the air supply chamber is introduced into the combustion chamber for scavenging, internally cooling and supercharging the combustion chamber in a short time. Further, because of such high compression, the exhaust gas is made to have a high flow speed which can be effectively utilized to drive a turbine for example.

Other objects, features and advantages of the present invention will be fully understood from the following detailed description given with reference to the accompanying drawings.

DETAILED DESCRIPTION OF THE PREFERRED EMBODIMENT

Figure 1:
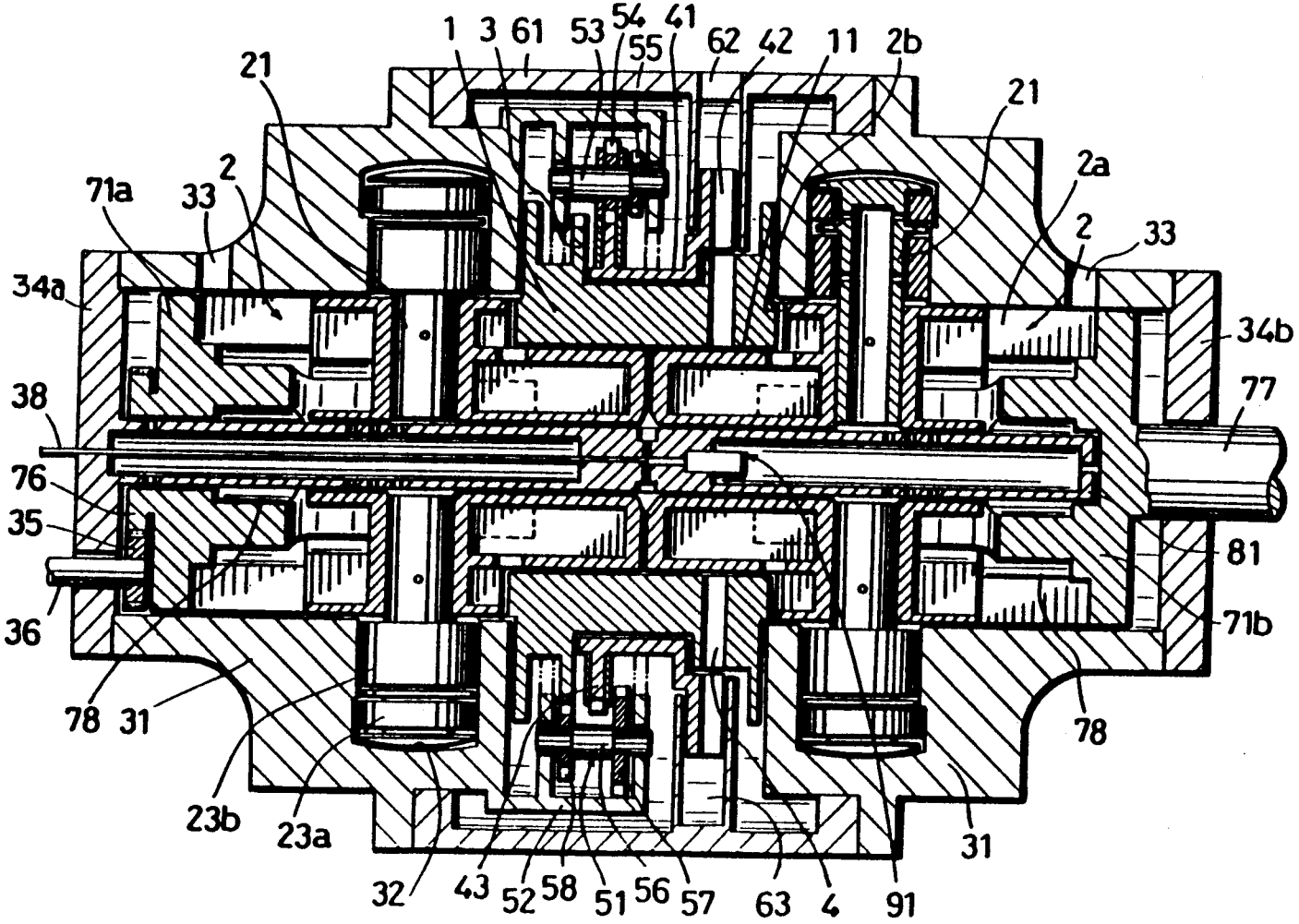
FIG. 1 is a side view, in longitudinal section, showing an internal combustion engine according to the present invention with pistons moved to the upper deadpoint.
Figure 2:
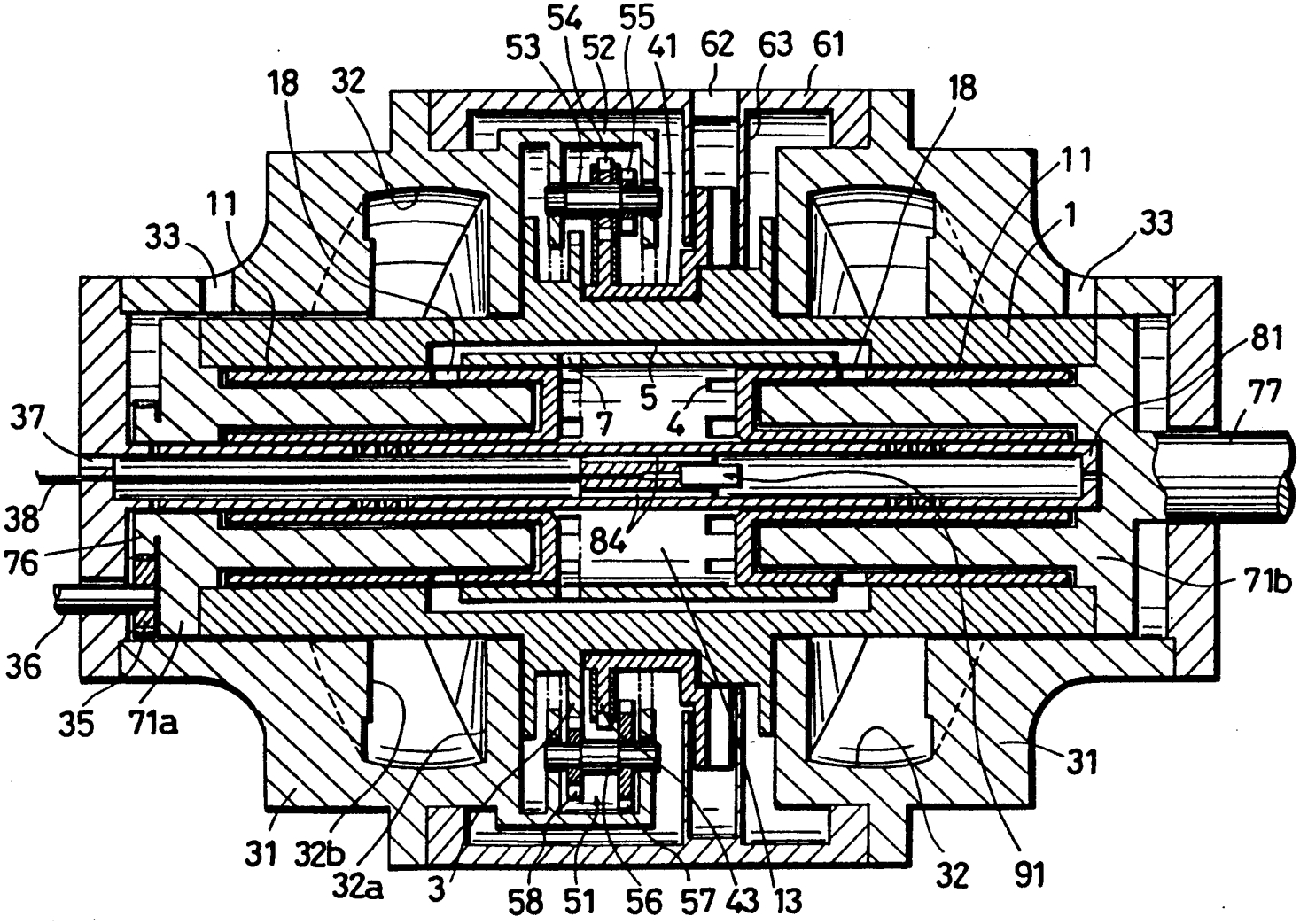
FIG. 2 is a view similar to FIG. 1 but showing the engine with the pistons moved to the lower deadpoint.

Referring first to FIGS. 1 and 2 of the accompanying drawings, there is illustrated an internal combustion engine according to the present invention. The illustrated engine mainly comprises a generally cylindrical engine body 1, an axially opposite pair of pistons 11 slidably guided by the engine body, a pair of fixed cam cylinders 31 fitted around the engine body in corresponding relation to the respective pistons. The engine body 1 corresponds to an engine cylinder of a conventional internal combustion engine, but differs therefrom in that the engine body itself is rotatable.

A combustion chamber 13 (see FIG. 2) is formed centrally within the engine body between the respective pistons 11, whereas a pair of air supply chambers 78 (see FIG. 1) are provided respectively at the opposite ends of the engine body. The air supply chambers 78 are respectively closed by a pair of chamber lids 71*a*, 71*b* mounted respectively to the opposite ends of the engine body.

Figure 3:
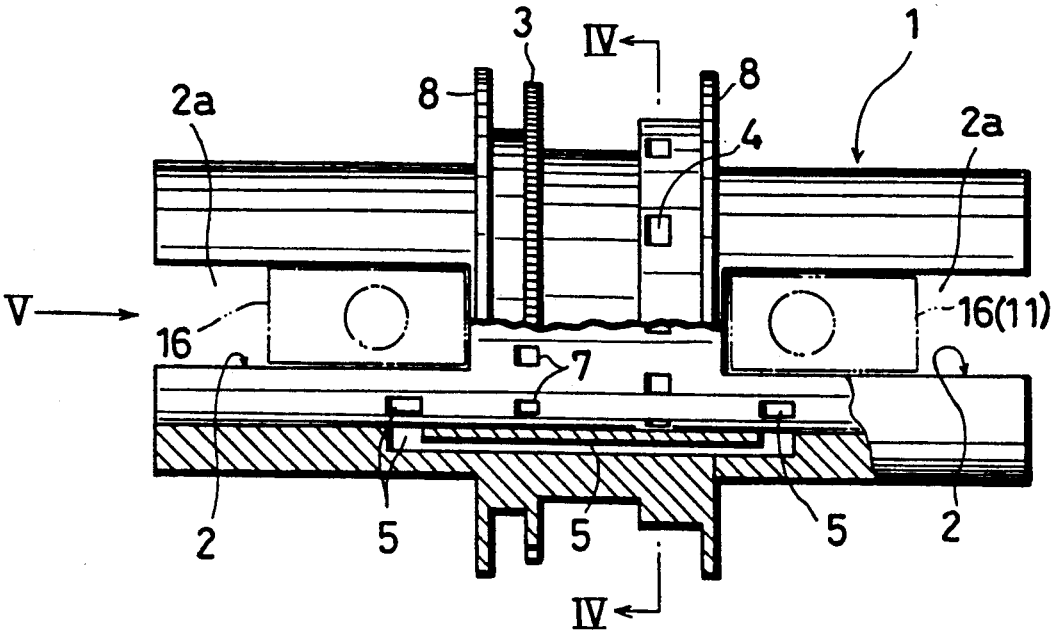
FIG. 3 is a plan view, partly cut away, showing an engine body.
Figure 4:
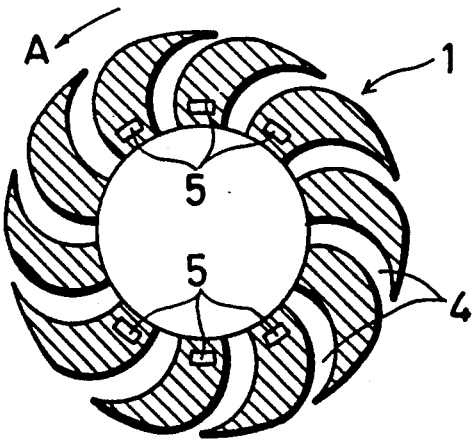
FIG. 4 is a sectional view taken along lines IV—IV in FIG. 3.
Figure 5:
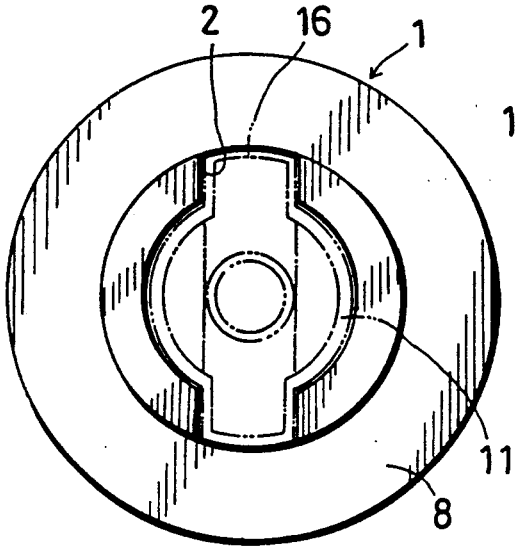
FIG. 5 is a view of the engine body as seen in the direction of arrow V in FIG. 3.

As shown in FIGS. 3 through 5, each end of the engine body 1 is formed with a diametrically opposite pair of axial guide slots 2 for slidably guiding the corresponding piston 11 (see particularly FIGS. 3 and 5). A non-slotted central portion of the engine body is externally formed with a pair of axially spaced annular thrust flanges 8. Between the thrust flanges 8 but closer to one of them, the engine body is integrally formed with an annular driven gear 3.

The engine body 1 is also formed with an annular series of exhaust ports 4 which communicate with the combustion chamber 13 only when the pistons 11 approach the lower deadpoint of reciprocation (FIG. 2). As best shown in FIG. 4, each exhaust port penetrates the wall thickness of the engine body 1 along an involute curve. Thus, the exhaust gas having passed through the exhaust port produces a rotational force A to assist rotation of the engine body.

The engine body 1 is further formed with air supply passages 5 extending axially in the wall thickness of the engine body and opening toward the respective pistons 11 (see FIG. 2). Further, the air supply passages communicate with the combustion chamber 13 through scavenging ports 7 which are opened only when the respective pistons 11 approach the lower deadpoint (see FIG. 2).

The pistons 11 are rotatably and slidably fitted on a fixed shaft 81 (see FIGS. 1 and 2). The respective pistons are identical in configuration to each other.

As shown in FIGS. 6 through 8*a*, each of the pistons 11 has an inner tube 12 fitted on the fixed shaft 81 (FIG. 1), an outer tube 14, and an annular piston head 15. The piston further has a diametrically opposite pair of box-like guide projections 16 which are fittable into the corresponding pair of guide slots 2 of the engine body 1 (see FIGS. 1 and 5). Thus, the piston is axially slidable relative to but rotatable with the engine body.

The piston 11 further has a transverse tube 17 extending from one guide projection 16 to the other for receiving a diametrically opposite pair of piston pins 21 (FIG. 1). The specific arrangement of the piston pins will be described later.

Figure 6:
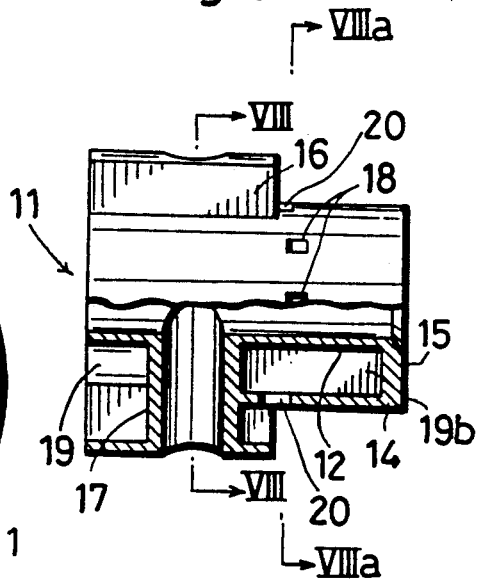
FIG. 6 is a side view, partly cut away, showing one of the pistons.
Figure 7:
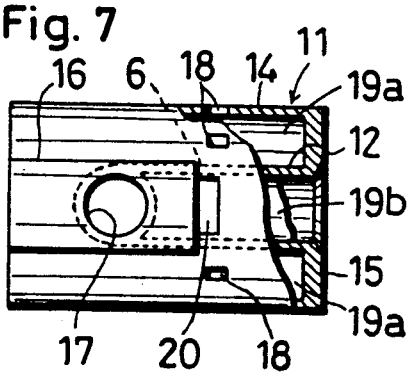
FIG. 7 is a plan view, partly cut away, showing the piston.
Figure 8:
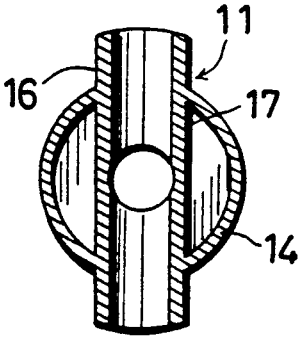
FIG. 8 is a sectional view taken along lines VIII—VIII in FIG. 6.
Figure 8A:
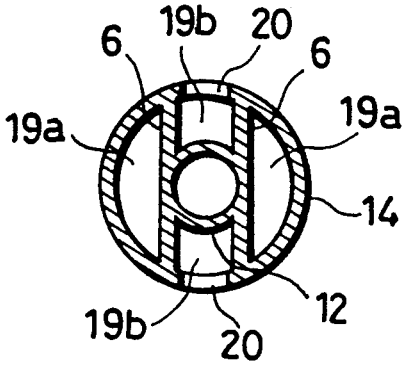
FIG. 8*a* is a sectional view taken along lines VIIIa—VIIIa in FIG. 6.

Within the piston 11, a pair of longitudinal partition walls 6 extend axially from the transverse tube 17 to the piston head 15, as clearly shown in FIGS. 7 and 8*a*. Thus, the space (piston space) between the inner and outer tubes 12, 14 of the piston consists of five sections. A main section 19 is located closest to the corresponding air supply chamber 78 in communication therewith (see FIGS. 1 and 6), and includes the interior of the respective guide projections 16. A pair of side sections 19*a* are located on both sides of the transverse tube 17 in communication with the main section 19, and extend axially from the main section 19 to the piston head 15 (see FIGS. 7 and 8*a*). A pair of intermediate sections 19*b* are located between the respective partition walls 6 respectively above and below the inner tube 12, and extend axially from the transverse tube 17 to the piston head 15 (FIGS. 6, 7 and 8*a*).

The main section 19 and side sections 19*a* of the piston space communicate with the corresponding air supply chamber 78 (FIG. 1), and therefore form part of the air supply chamber. On the other hand, the intermediate sections 19*b* are pneumatically independent from the air supply chamber 78 due to the presence of the transverse tube 17 and the longitudinal partition walls 6.

The outer tube 14 of the piston 11 is formed with air supply ports 18 (FIGS. 6 and 7) which communicate with the respective air supply passages 5 of the engine body 1 only when the piston approaches the lower deadpoint (FIG. 2). The air supply ports 18 also communicate with the side sections 19*a* of the piston space. Further, the outer tube 14 is formed with a diametrically opposite pair of pressure relief ports 20 which communicate with the respective intermediate sections 19*b* of the piston space.

As clearly shown in FIG. 1, each guide slot 2 of the engine body 1 is divided by the corresponding guide projection 16 of the piston 11 into an axially outer section 2*a* and an axially inner section 2*b*. The slot outer section 2*a* forms part of the corresponding air supply chamber 78, and is compressed when the piston makes its stroke toward the lower deadpoint. The slot inner section 2*b* communicates with the corresponding intermediate section 19*b* of the piston space through the corresponding pressure relief port 20, and is compressed when the piston makes its stroke toward the upper deadpoint. However, since the air trapped in the slot inner section 2*b* can escape into the intermediate section 19*b* of the piston space through the pressure relief port 20 during the stroke of the piston toward the upper deadpoint, the pressure increase within the slot inner section 2*b* is suitably limited to allow smooth returning stroke of the piston toward the upper deadpoint.

Figure 9:
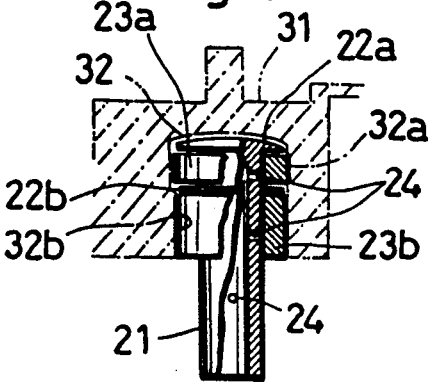
FIG. 9 is a view, partly cut away, showing a piston pin.
Figure 10:
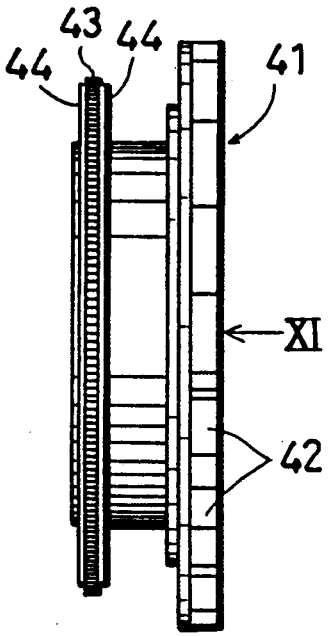
FIG. 10 is a side view showing an exhaust turbine.
Figure 11:
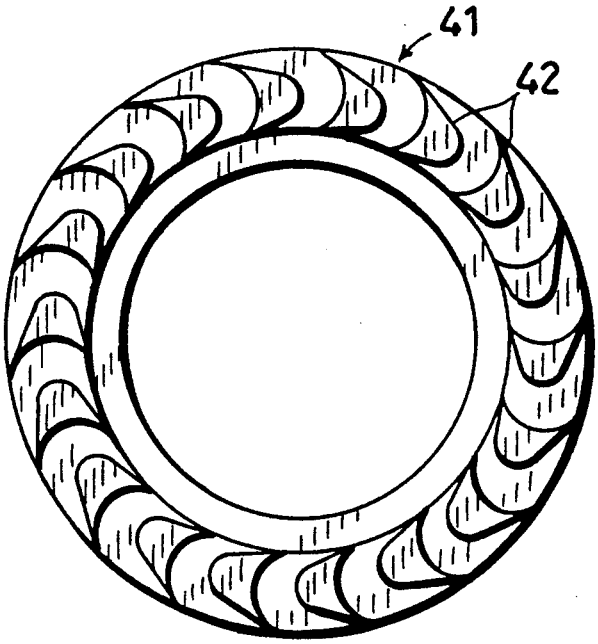
FIG. 11 is a view of the turbine as seen in the direction of arrow XI.
Figure 12:
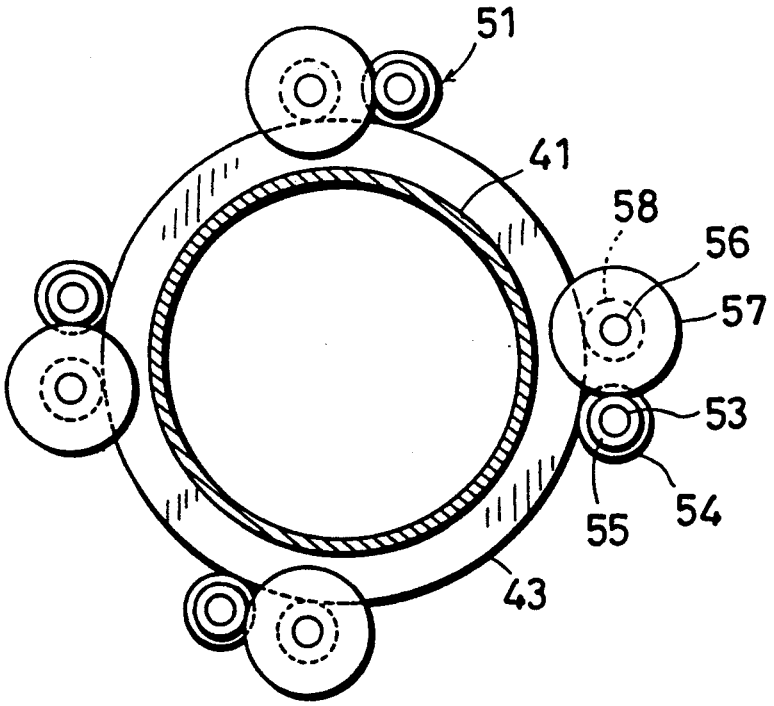
FIG. 12 is a front view showing a transmission gear mechanism together with the exhaust turbine.

Each piston pin 21 functions as a cam follower which is cooperative with the corresponding cam cylinder 31, as described hereinafter. As best shown in FIG. 9, the piston pin is tubular, and has an outer end formed with a first thrust bearing flange 22*a* which resembles an umbrella. The piston pin further has a second thrust bearing flange 22*b* slightly spaced from the first thrust bearing flange.

A first roller 23*a* is rotatably fitted on the piston pin 21 between the first and second thrust bearing flanges 22*a*, 22*b*. A second roller is also fitted on the piston pin axially inwardly of the second thrust bearing flange 22*b*. The first roller 23*a* is slightly larger in diameter than the second roller 23*b* for the purpose to be described later. Indicated at 24 are lubrication ports 24 suitably formed in the wall thickness of the piston pin.

Each cam cylinder 31 is fitted around the corresponding slotted end portion of the engine body in facing relation to the corresponding thrust flange 8, as shown in FIGS. 1 and 2. The cam cylinder is internally formed with a cam groove 32 for fittably receiving the rollers 23*a*, 23*b* of the respective piston pins 21. The cam groove is curved substantially along a sinous curve, so that the corresponding piston 11 together with the engine body 1 makes one full rotation as the piston makes two reciprocations.

The cam groove 32 has an inner track (axially inner lateral surface) 32*a* and an outer track (axially outer lateral surface) 32*b*. As shown in FIGS. 1 and 9, the inner track 32*a* comes into contact only with the first roller 23*a* of each piston pin 21, whereas the outer track 32*b* is slightly stepped to come into contact only with the second roller 23*b*. As described before, the first roller 23*a* is diametrically larger than the second roller 23*b*. It is this diametrical difference that enables such a differential contact of the respective rollers relative to the respective cam tracks.

It is now supposed that the piston pin 21 carries only a single roller. In such an arrangement, the roller must pressingly contact alternately with the respective tracks 32*a*, 32*b* of the cam groove 32, and alternation occurs upon every change in reciprocating direction of the piston 11. However, the inner and outer cam tracks 32*a*, 32*b* cause the roller to rotate in the opposite directions as long as the piston 11 keeps on rotating in one direction. Thus, a great friction occurs between the roller and the respective cam tracks upon every change in reciprocating direction of the piston, thereby impairing smooth operation of the engine and resulting in a great energy loss.

According to the illustrated embodiment, the first roller 23*a* contacts only the inner cam track 32*a* and keeps on rolling only in one direction, whereas the second roller 23*b* contacts only the outer cam track 32*b* and keeps on rolling only in the opposite direction. Thus, the piston 11 is capable of smoothly rotating and reciprocating with a greatly reduced frictional energy loss. Further, the use of two rollers 23*a*, 23*b* for each piston pin 21 is preferred to reduce the bearing burden on each roller.

Moreover, according to the illustrated embodiment, the second roller 23*b* has a larger axial length (bearing width) than the first roller 23*a*. Such an arrangement is preferred to prevent the second roller 23*b* from being overloaded because the second roller is strongly pressed against the outer cam track 32*b* when the combustion chamber 13 is explosively expanded.

The cam cylinder 31 is formed with an air suction port 33 at a position axially outwardly of the cam groove 32. The suction port communicates with the corresponding air chamber 78 when either one of the respective guide slots 2 of the engine body 1 overlaps the suction port; that is, when the corresponding piston 11 approaches the upper deadpoint of reciprocation, as shown in FIG. 1. In this way, air is introduced into the air supply chamber 78.

The pair of cam cylinders 31 have axially outer ends closed respectively by a pair of closure plates 34*a*, 34*b*. One closure plate 34*b* (right one in FIGS. 1 and 2) is rotatably penetrated by a main output shaft 77 to take out the engine drive power.

The central portion of the other closure plate 34*a* (left one in FIGS. 1 and 2) is integral with the fixed shaft 81 which is coaxial with the output shaft 77. An offset portion of the same closure plate 34*a* is rotatably penetrated by a auxiliary output shaft 36 used for driving unillustrated auxiliary parts such as a lubricant supply pump and a fuel supply pump. The auxiliary output shaft is fixed to a driven gear 35 which is rotated by the rotation of the engine body 1, as hereinafter described. Indicated at 37 is a lubricant supply port formed through the closure plate 34*a* to open into the fixed shaft 81, and at 38 is a fuel supply line connected to a fuel supply pump (not shown) and extending into the fixed shaft.

As shown in FIGS. 1, 2, 10 and 11, an exhaust turbine 41 is rotatably arranged around the non-slotted central portion of the engine body 1. The turbine has an annular series of turbine blades 42 arranged to surround the annular series of exhaust ports 4 of the engine body (see FIGS. 1 and 2), so that the turbine is rotated by the whirling exhaust gas which has passed through the exhaust ports 4. The turbine further has an annular drive gear 43 which is directly flanked by a pair of bearing annuli 44. Each bearing annulus 44 has an outer diameter substantially corresponding to the pitch diameter of the drive gear 43. Rotation of the exhaust turbine 41 is transmitted to the engine body 1 by way of a transmission gear mechanism 51.

Figure 13:
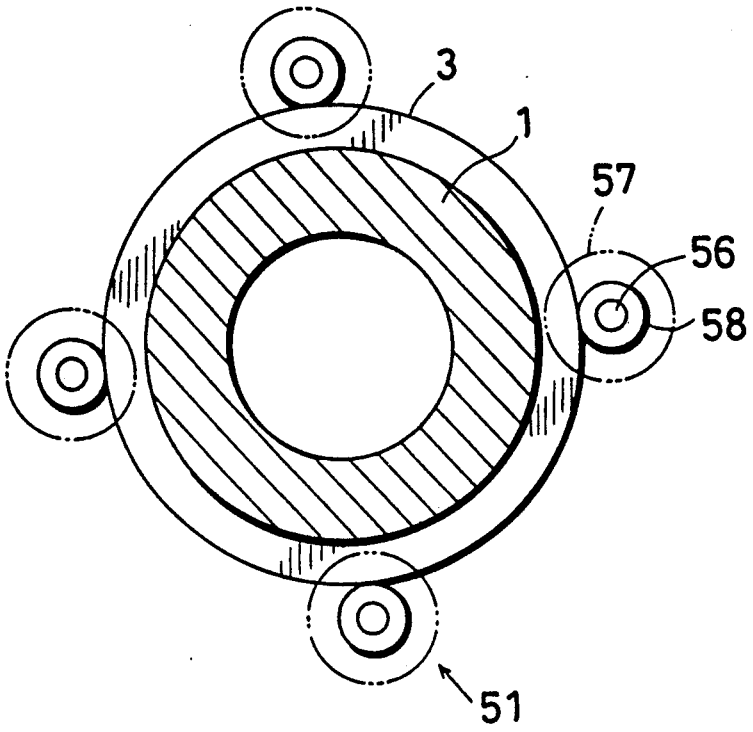
FIG. 13 is a front view showing the transmission gear mechanism together with the engine body.

As shown in FIGS. 1, 2, 12 and 13, the transmission gear mechanism 51 is mounted on a gear casing 52 which is integral with one of the cam cylinders 31. The gear casing rotatably supports a first group of shafts 53 (four in the illustrated embodiment). Each of the first group shafts 53 carries a first transmission gear 54 in mesh with the drive gear 43 of the turbine 41, and a second transmission gear 55. Further, the gear casing rotatably supports a second group of shafts 56 (also four in the illustrated embodiment). Each of the second group shafts 56 carries a third transmission gear 57 in mesh with the second transmission gear 55 (FIG. 12), and a fourth transmission gear 58 in mesh with the annular driven gear 3 of the engine body 1 (FIG. 13).

According to the illustrated embodiment, the exhaust turbine 41 is rotated in the opposite direction relative to the engine body 1 by the exhaust gas. Such rotation of the turbine is in turn utilized to drive the engine body through the transmission gear mechanism 51. Thus, the heat and flow energy of the exhaust gas is effectively recovered to increase the output of the engine. Further, the turbine can also function as a flywheel for the engine, and no separate flywheel is necessary, as opposed to the conventional reciprocating engine.

Figure 14:
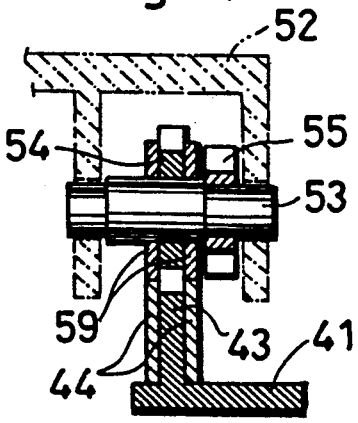
FIG. 14 is a an enlarged fragmentary view showing a portion of the transmission gear mechanism.

As better shown in FIG. 14, each of the first group shafts 53 further carries a pair of bearing rings 59 directly on both sides of the corresponding first transmission gear 54. The respective bearing rings 59 have an outer diameter substantially corresponding to the pitch diameter of the first transmission gear 54, and are held in rolling contact with the respective bearing annuli 44 of the turbine 41.

The combination of the bearing rings 59 and the bearing annuli 44 prevents the turbine 41 from displacing axially and radially. Thus, the turbine can be held floating around the engine body 1 without requiring to provide a bearing between the turbine and the engine body although a bearing, preferably a magnetic bearing, may be inserted between these two parts.

The gear ratio of the transmission mechanism 51 may be optionally selected depending on various requirements. Further, the bearing rings 59 may be provided in any number of pairs, but at least three pairs of such bearing rings need be provided to enable supporting the turbine 41 in a floating state.

The turbine 41 is surrounded by a cylindrical housing 61 which is also used to couple between the pair of cam cylinders 31 (see FIGS. 1 and 2). The housing 61 is provided with an annular blade chamber 63 for accommodating the annular series of turbine blade 42. The housing 61 is further provided with an exhaust discharge port 62 in communication with the blade chamber 63 to enable discharge of the exhaust gas after driving the turbine.

The respective chamber lids 71*a*, 71*b* are attached respectively to the opposite ends of the engine body 1 for rotation therewith (see FIGS. 1 and 2) on the fixed shaft 81. One chamber lid 71*a* is integrally formed with a drive gear 76 in mesh with the driven gear 36 for driving the auxiliary output shaft 36 which is connected to the unillustrated auxiliary parts, whereas the other chamber lid 71*b* is formed integral with the main output shaft 77. The two chamber lids 71*a*, 71*b* are otherwise similar in configuration to each other.

Figure 15:
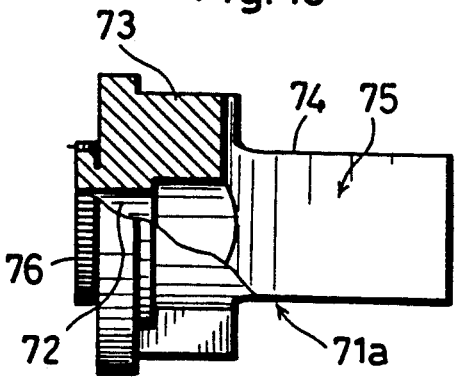
FIG. 15 is a side view, partly cut away, showing a chamber lid.
Figure 16:
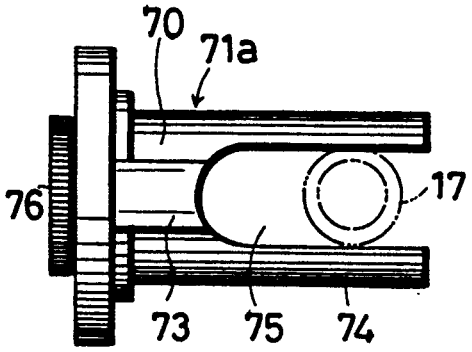
FIG. 16 is a plan view showing the chamber lid.
Figure 17:
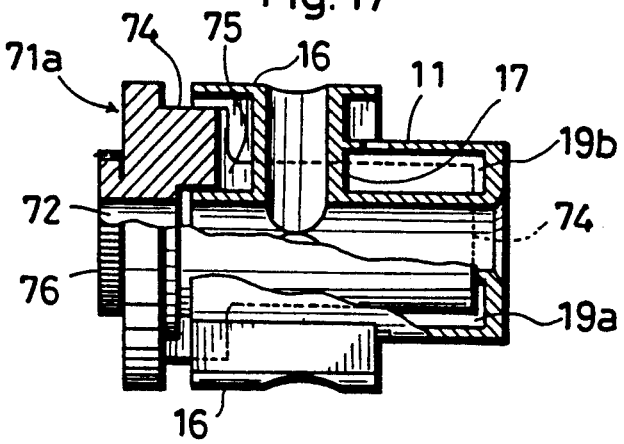
FIG. 17 is also a side view, partly cut away, showing the chamber lid together with the corresponding piston.

As illustrated in FIGS. 15 through 17, each of the chamber lids (only the left chamber lid 71*a* shown in these figures) has an axial bore 72 for receiving the fixed shaft 81. The chamber lid has a cylindrical lid body 70 formed with a diametrically opposite pair of block-like projections 73 in corresponding relation to the box-like projections 16 of the corresponding piston 11. The lid body 70 together with the block-like projections 73 is insertable into the main section 19 of the piston space (FIG. 17) when the piston 11 approaches the lower deadpoint.

The chamber lid further has a laterally spaced pair of legs 74 extending longitudinally from the lid body 70 to define a longitudinal slot 75 which has a width slightly larger than the outer diameter of the transverse tube 17 of the piston 11. Thus, the legs 74 of the chamber lid are fully insertable into the respective side sections 19*a* of the piston space when the piston approaches the lower deadpoint.

Each air chamber 78 is provided between the corresponding chamber lid and piston, and enlarged by the main and side sections 19, 19*a* of the piston space. Further, the axially outer section 2*a* of each guide slot 2 of the engine body 1 is also used to form part of the air chamber. Thus, a comparatively large amount of air can enter into the air supply chamber 78 when the piston 11 approaches the upper deadpoint to open the air suction port 33 (FIG. 1).

On the other hand, when the piston 11 approaches the lower deadpoint with the air suction port 33 closed by the rotationally displaced engine body 1 (FIG. 2), the air introduced into the air supply chamber 78 is compressed to a very high degree because the legs 74 of the corresponding chamber lid are fully insertable into the side sections 19*a* of the piston space to maximally reduce the clearance volume of the air supply chamber at the time of such compression. Without the legs 74, obviously, the air compression ratio within the air supply chamber becomes considerably lower.

The highly compressed air within the air supply chamber 78 flows into the combustion chamber 13 through the air supply ports 18, the air supply passages 5 and the scavenging ports 7 when the scavenging ports 7 are opened by the axially displaced piston 11 (FIG. 2). The compressed air thus introduced is effectively used for scavenging, internally cooling and supercharging the combustion chamber 13 within a very short time. On the other hand, the exhaust gas which has resulted from such scavenging and internal cooling is effectively utilized for driving the exhaust turbine 41 to recover the heat and flow energy of the exhaust gas, as already described.

Figure 18:
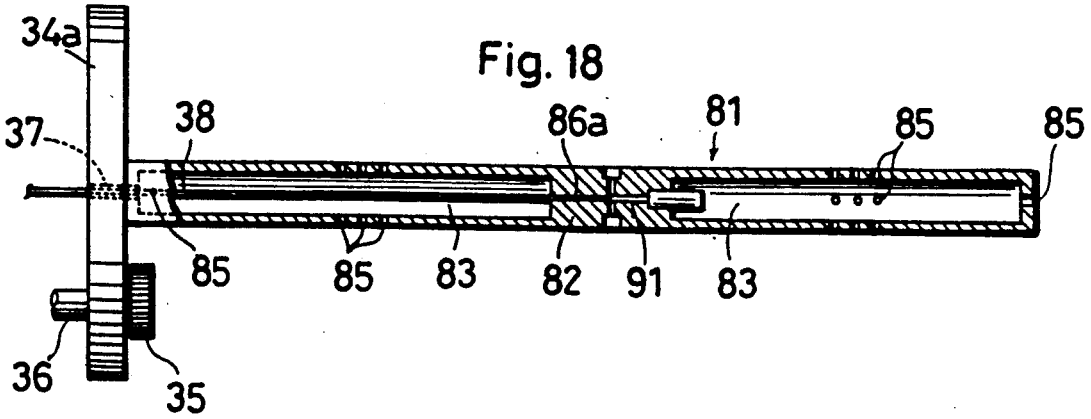
FIG. 18 is a side view, partially in section, showing a fixed shaft.

As shown in FIG. 18, the fixed shaft 81 is substantially hollow, but has an intermediate solid mounting portion 82 which separates the interior space into two oil chambers 83. The mounting portion 81 is formed with longitudinal oil passages 84 (see FIG. 2) for establishing communication between the two oil chambers 83. The fixed shaft is further formed with lubrication ports 85 communicating with the respective oil chambers.

As already described, the lubricant oil enters into the fixed shaft 81 through the lubricant supply port 37 under the feed pressure of the unillustrated lubricant supply pump. The lubricant thus introduced is fed to the inner surfaces of the respective pistons 11 and chamber lids 71*a*, 71*b* through the lubrication ports 85. Then, the lubricant is centrifugally brought outward to the engine body 1 as well as other rotary and slidable parts. Particularly, a part of the lubricant flows into the respective piston pins 21, and then to the rollers 23*a*, 23*b* and the cam grooves 32.

Figure 19:
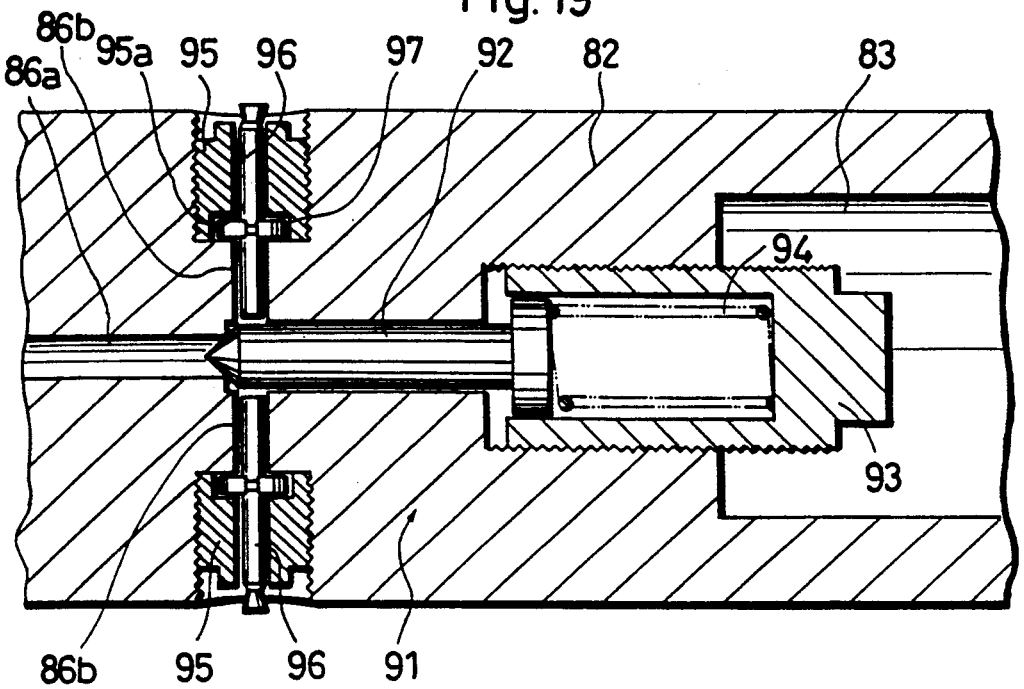
FIG. 19 is a view, in longitudinal section, showing a fuel injection device.

As shown in FIGS. 18 and 19, the solid mounting portion is also formed with a longitudinal fuel passage 86*a* and a pair of transverse fuel passages 86*b* branching from the longitudinal fuel passage. The longitudinal fuel passage 86*a* is connected to the fuel supply line 38 which is in turn connected to the unillustrated fuel supply pump.

The fuel supply to the combustion chamber 13 (FIG. 2) is controlled by a fuel injection device 91. The fuel injection device includes a pressure sensitive valve 92, a pair of injection nozzles 95, and a pair of needle valves 96.

The pressure sensitive valve 92 is in the form of a stem axially slidably supported by the mounting portion 82 of the fixed shaft 81 and arranged coaxially with the longitudinal fuel passage 86*a*. The valve 92 normally closes the longitudinal fuel passage under the urging force of a compression coil spring 94 housed in an cylindrical adjuster which is screwed into the mounting portion 82. On the other hand, the valve 92 opens the longitudinal fuel passage when the fuel supply pressure overcomes the urging force of the spring 94, and the fuel flows into the transverse fuel passages 86*b*. The fuel injection pressure may be adjusted by screwably advancing or retreating the adjuster 93.

The unillustrated fuel supply pump, which may be driven by the auxiliary output shaft 36 (FIGS. 1 and 2), causes the fuel supply pressure within the longitudinal fuel passage 86*a* to alternately increase and decrease in timed relation to the engine operation. Thus, the fuel is injected into the combustion chamber 13 (FIG. 2) when the fuel pressure increases to cause retreating movement of the pressure sensitive valve 92, and the fuel injection is interrupted when the fuel pressure decreases.

Each of the injection nozzles 95 is screwed transversely into the mounting portion 82 of the fixed shaft 1 in alignment with the corresponding transverse fuel passage 86*b* to form a part of the transverse fuel passage. The injection nozzle is formed with a recess 95*a*.

Each of the needle valves 96 is accommodated in the corresponding transverse fuel passage 86*b*. The needle valve is provided, at an intermediate portion thereof, with an annular flange 97 which is disposed in the nozzle recess 95*a*. As clearly appreciated from FIG. 19, a small fuel passage gap is formed all around the outer surfaces of the needle valve 96 including the flange 97. Thus, the fuel can flow through this gap, and the needle valve itself is movable axially and tiltable slightly within a small range allowed by the gap.

Figure 20:
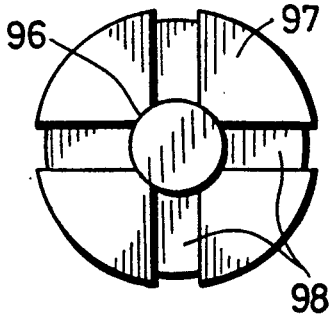
FIG. 20 is a plan view of a needle valve incorporated in the fuel injection device.
Figure 21:
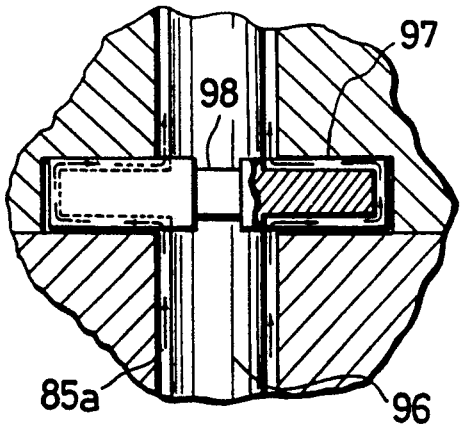
FIG. 21 is a view, partly cut away, showing the needle valve.

As shown in FIGS. 20 and 21, the annular flange 97 of the needle valve 96 is formed with fuel passage grooves 98. Thus, the fuel flow is caused to bend along these grooves (see the arrows in FIG. 21), and the resistance to the fuel flow is increased by such bending. The grooves 98 insure that the fuel can flow past the flange 97 even if the fuel pressure causes the flange 97 to come into contact with the bottom surface of the recess 95*a*.

The fuel injection device 91 described above is advantageous in the following respects.

First, the pressure sensitive valve 92 and adjuster 93, which are relatively bulky parts, are arranged coaxially with the fixed shaft 81, so that the diameter of the fixed shaft may be rendered small. Such an arrangement is preferred for making compact the engine as a whole.

Second, the provision of the needle valve 96 within the corresponding transverse fuel passage 86*b* is effective for reducing the fuel passage cross-sectional area. Such an arrangement is preferable in insuring that the fuel is formed into minute particles when injected into the combustion chamber.

In the third place, the needle valve 96 is movable axially and tiltable within the small range allowed by the small fuel passage gap, as already described. Such movement or tilting of the needle valve 96 is effective for producing minute fuel particles of various sizes. Obviously, differently sized fuel particles are also different in dispersing ability within the combustion chamber 13 because smaller particles are more easily carried away by the air (introduced into the combustion chamber) than larger particles. Thus, the injected fuel, because of particle size variation, can be uniformly dispersed in the combustion chamber before the explosion occurs in the combustion chamber. Further, slight movability and tiltability of the needle valve 96 is also effective for cleaning the transverse fuel passage 86*b* which may be otherwise clogged up by combustion products.

In the fourth place, bending of the fuel flow provided by the flange 97 of the needle valve 96 results in an increased flow resistance. This arrangement is preferable to prevent unexpected spilling, into the combustion chamber 13, of the fuel after closing the pressure sensitive valve 92. In other words, the fuel injection into the combustion chamber is performed only when the pressure sensitive valve 92 is opened to increase the fuel pressure within the transverse fuel passage 86*b* to a level enough to overcome the flow resistance. Thus, it becomes possible to accurately control the fuel injection (including the fuel injection interruption) in timed relation to the engine operation.

Though not specifically illustrated, suitable seals are provided for those portions which require gas tightness, and suitable bearings are provided for various rotary parts.

The engine according to the illustrated embodiment operates in the following manner.

The engine operation is started by actuating an unillustrated starter which is connected to the main output shaft 77 (FIGS. 1 and 2). The engine body 1 together with each piston 11 makes one full rotation as the piston makes two reciprocations, as already described. FIG. 1 shows the upper deadpoint of the piston reciprocation, whereas FIG. 2 represents the lower deadpoint.

During movement of the respective pistons 11 from the lower deadpoint of FIG. 2 toward the upper deadpoint of FIG. 1, the air within the combustion chamber 13 is compressed immediately after the exhaust ports 4 are closed. On the other hand, a new supply of air is introduced into the respective air supply chambers 78 when the respective air suction ports 33 overlap the respective guide slots 2 of the engine body 1.

Immediately before the pistons 11 reach the upper deadpoint of FIG. 1, an amount of fuel is injected into the combustion chamber 13 and spontaneously ignited due to the temperature elevation caused by the air compression within the combustion chamber substantially in the same manner as a known diesel engine. As a result, an explosion takes place within the combustion chamber, and the pistons are moved toward the lower deadpoint by the explosive expansion of the combustion chamber. The fuel injection is interrupted immediately after the pistons have moved past the upper deadpoint.

When the pistons 11 have moved past the upper deadpoint, the air suction ports 33 no longer overlap the guide slots 2 of the engine body 1 because of rotational displacement of the engine body. Thus, the explosive expansion of the combustion chamber 13 causes simultaneous compression of the respective air supply chambers 78.

During movement of the respective pistons 11 toward the lower deadpoint, the exhaust ports 4 are opened, and the scavenging ports 7 are also opened almost simultaneously with or slightly after opening of the exhaust ports (see FIG. 2). Further, the air supply passages 5 overlap and communicate with the air supply ports 18 of the respective pistons. As a result, the air, which has been previously compressed to a very high extent within the respective air supply chambers 78, is forcibly introduced under high pressure into the combustion chamber 13 for scavenging, internally cooling and supercharging the combustion chamber in a short time.

On the other hand, the exhaust gas leaves the engine body 1 through the open exhaust ports 4 which are curved in involute form (see FIG. 4). The flow direction of the exhaust gas exiting from the exhaust ports 4 is such as to assist rotation of the engine body. Further, the exhaust gas is also used to rotate the exhaust turbine 41, and such rotation of the turbine is utilized to assist rotation of the engine. In this way, the heat and flow energy of the exhaust gas is effectively recovered to increase the thermal efficiency of the engine.

After the respective pistons 11 have moved past the lower deadpoint, the pistons move again toward the upper deadpoint to close the exhaust and scavenging ports 4, 7. Thus, compression of the combustion chamber 13 is repeated, while the respective air supply chambers 78 are expanded to introduce another supply of air.

The engine according to the illustrated embodiment operates constantly by repeating the above cycle. Obviously, the basic cycle of the inventive engine resembles that of a conventional two-cycle reciprocating engine, but differs therefrom in that the former makes a half rotation per one reciprocation of the piston, whereas the latter makes one full rotation per one reciprocation of the piston.

According to the present invention, the engine body 1 itself rotates together with the pistons 11 which also make axial reciprocation. Thus, the engine of the present invention requires no crank mechanism which may result in a considerable energy loss. Further, rotation of the engine body imparts rotating motion to the air within the combustion chamber 13, so that mixing of the injected fuel with the air is enhanced to enable ideal combustion.

The most significant feature of the present invention resides in that the legs 74 of each chamber lid are insertable into the side sections 19*a* of the corresponding piston space to enable compressing the corresponding air supply chamber 78 to a very high extent when the piston 11 approaches the lower deadpoint. The highly compressed air within the air supply chamber 78 is effectively used for scavenging, internally cooling and supercharging the combustion chamber 13 within a short time. Further, the resulting exhaust gas discharged at high speed is effectively utilized for rotationally driving the engine body 1 by means of the involute-curve exhaust ports 4 and the exhaust turbine 41. Moreover, since the air supply chamber 78 is highly compressed near the lower deadpoint of the piston 11, the high pressure developed in the air supply chamber is utilized as a spring for pushing back the piston toward the upper deadpoint to assist the piston reciprocation.

According to the present invention, the combustion chamber is internally cooled by the compressed air introduced from the respective air supply chambers 78. Such internal cooling is preferred because no separate coolant passages need be provided externally of the engine body 11, and the space around the engine body may be used for arranging other useful components such as an exhaust turbine.

Obviously, a plurality of engines according to the present invention may be connected in one or plural series. Alternatively, a plurality of engines according to the present invention may be arranged at the respective corners of a polygon, and the main output shafts of the respective engines may be rotationally coupled by gears.

The present invention being thus described, it is obvious that the same may be varied in many ways. For instance the illustrated engine may be modified to include spark plugs for performing spark ignition of the air-fuel mixture within the combustion chamber. Such variations are not to be regarded as a departure from the spirit and scope of the invention, and all such modifications as would be obvious to those skilled in the art are intended to be included within the scope of the following claims.

We claim:

1. An internal combustion engine comprising:

an engine body having a piston housing bore;

an axially opposed pair of pistons disposed within the bore of the engine body to define a combustion chamber between the pair of pistons, the respective pistons being concentric with the engine body and rotatable therewith about a fixed concentric shaft, the respective pistons being slidably reciprocatable between upper and lower deadpoints relative to the engine body, each piston carrying cam follower means extending transversely through the engine body;

hollow cam carrier means rotatably receiving the engine body, the cam carrier means internally having a pair of curved cam grooves each receiving the cam follower means of said each piston for causing said each piston to make one full rotation with the engine body as said each piston makes two reciprocations;

a pair of chamber lids each mounted to the engine body for rotation therewith and defining an air supply chamber extending into said each piston from the side thereof axially away from the combustion chamber, each lid having an extension which is insertable substantially fully into said each piston when said each piston moves to the lower deadpoint;

fuel injection means for injecting a fuel into the combustion chamber;

air entry means for supplying compressed air from the air supply chamber into the combustion chamber as said each piston approaches the lower deadpoint; and exhaust means for allowing exit of exhaust gas from the combustion chamber as said each piston approaches the lower deadpoint;

wherein said each piston includes an inner tube fitted on the fixed shaft, an outer tube surrounding the inner tube, an annular piston head connecting between the inner and outer tubes at a position facing the combustion chamber, a transverse tube extending perpendicularly through the inner and outer tubes for receiving the cam follower means, and a pair of partition walls extending from the transverse tube to the piston head for dividing a space behind the transverse tube into a pair of side sections on both sides of the transverse tube and a pair of intermediate sections between the pair of partition walls; and wherein the extension of said each lid comprises a pair of legs insertable into the side sections of said each piston past the transverse tube.

2. The engine according to claim 1, wherein said exhaust means comprises an annular series of exhaust ports formed in said engine body and curved to impart whirling motion to the exhaust gas upon passage through the exhaust ports for assisting rotation of the engine body.

3. The engine according to claim 2, further comprising an exhaust turbine rotated around the engine body by the exhaust gas, and a transmission gear mechanism for transmitting rotation of the turbine to the engine body to assist rotation thereof.

4. The engine according to claim 3, wherein the exhaust turbine carries an annular drive gear flanked by a pair of bearing annuli each having an outer diameter substantially corresponding to the pitch diameter of the drive gear, said transmission gear mechanism comprising a group of at least three shafts rotatably supported by the cam carrier means, each of the grouped shafts carrying a transmission gear which is held in mesh with the drive gear and flanked by a pair of bearing rings in rolling contact with the respective bearing annuli, each of the bearing rings having an outer diameter substantially corresponding to the pitch diameter of the transmission gear, whereby the exhaust turbine is supported by the transmission gear mechanism in both axial and radial directions.

5. The engine according to claim 4, wherein each of the grouped shafts further carries a second transmission gear, the transmission gear mechanism further comprising a second group of at least three shafts rotatably supported by the cam carrier means, each of the second group shafts carrying a third transmission gear in mesh with the second transmission gear, each of the second group shafts further carrying a fourth transmission gear in mesh with an annular driven gear which is carried by the engine body.

6. The engine according to claim 1, wherein each of the cam grooves has a first cam track and a second cam track, the cam follower means of said each piston comprising a diametrically opposite pair of piston pins, each of the piston pins rotatably carrying a first roller which comes into rolling contact only with the first cam track, each of the piston pins further rotatably carrying a second roller which comes into rolling contact only with the second cam track.

7. The engine according to claim 6, wherein the first roller is diametrically larger than the second roller, the second cam track being slightly stepped to come into rolling contact only with the second roller.

8. The engine according to claim 6, wherein the second roller has a wider contact width than the first roller.

9. The engine according to claim 1, wherein the fixed shaft is hollow but has an intermediate solid mounting portion for mounting the fuel injection means.

10. The engine according to claim 9, wherein the fuel injection means comprises a longitudinal fuel passage formed at the solid mounting portion of the fixed shaft and connected to a fuel supply line, a diametrically opposite pair of transverse fuel passages also formed at the mounting portion and branching from the longitudinal fuel passage to open into the combustion chamber, and valve means for controlling the fuel flow through the longitudinal and transverse fuel passages.

11. The engine according to claim 10, wherein the valve means comprises a pressure sensitive valve slidably disposed on the mounting portion of the fixed shaft in alignment with the longitudinal fuel passage and normally urged by a spring to close the longitudinal fuel passage relative to the transverse fuel passages, the pressure sensitive valve being opened against the spring when the fuel pressure within the longitudinal fuel passages exceeds a preset value.

12. The engine according to claim 11, wherein the preset value for the fuel pressure is variable by an adjuster.

13. The engine according to claim 11, wherein the valve means further comprises a pair of needle valves respectively accommodated in the transverse fuel passages to define a fuel passage gap, each needle valve being movable within a small range allowed by the fuel passage gap.

14. The engine according to claim 11, wherein each needle valve has an intermediate annular flange which is formed with a plurality of fuel passage grooves.

15. An internal combustion chamber engine comprising:

an engine body which has an axial bore defining a combustion chamber;

at least one piston disposed within the bore of the engine body to face the combustion chamber, the piston being concentric with the engine body and rotatable therewith about a concentric axis, the piston being slidably reciprocatable between upper and lower deadpoints relative to the engine body;

means for rotatably supporting the engine body;

a cam mechanism supported by cam carrier means for causing the piston to make one full rotation with the engine body as the piston makes two reciprocations;

an air supply chamber formed on the side of the piston axially away from the combustion chamber, the air supply chamber being compressible when the piston moves toward the lower deadpoint;

fuel injection means for injecting a fuel into the combustion chamber;

means for introducing compressed air from the air supply chamber into the combustion chamber and for expelling exhaust gas from the combustion chamber as the piston approaches the lower deadpoint;

an exhaust turbine driven by the exhaust gas; and a transmission gear mechanism for transmitting rotation of the turbine to the engine body to assist rotation thereof;

wherein the exhaust turbine carries an annular drive gear flanked by a pair of bearing annuli each having an outer diameter substantially corresponding to the pitch diameter of the drive gear, and wherein the transmission gear mechanism comprises a group of at least three shafts rotatably supported by the cam carrier means, each of the grouped shafts carrying a transmission gear which is held in mesh with the drive gear and flanked by a pair of bearing rings in rolling contact with the respective bearing annuli, each of the bearing rings having an outer diameter substantially corresponding to the pitch diameter of the transmission gear, whereby the exhaust turbine is supported by the transmission gear mechanism in both axial and radial directions.

16. The engine according to claim 15, wherein each of the grouped shafts further carries a second transmission gear, the transmission gear mechanism further comprising a second group of at least three shafts rotatably supported by the cam carrier means, each of the second group shafts carrying a third transmission gear in mesh with the second transmission gear, each of the second group shafts further carrying a fourth transmission gear in mesh with an annular driven gear which is carried by the engine body.

17. An internal combustion engine comprising:

an engine body which has an axial bore defining a combustion chamber;

at least one piston disposed within the bore of the engine body to face the combustion chamber, the piston being concentric with the engine body and rotatable therewith about a fixed concentric shaft, the piston being slidably reciprocatable between upper and lower deadpoints relative to the engine body, the fixed shaft being hollow and having an intermediate solid mounting portion;

means for rotatably supporting the engine body;

a cam mechanism supported by cam carrier means for causing the piston to make one full rotation with the engine body as the piston makes two reciprocations;

an air supply chamber formed on the side of the piston axially away from the combustion chamber, the air supply chamber being compressible when the piston moves toward the lower deadpoint;

fuel injection means mounted on the fixed shaft for injecting a fuel into the combustion chamber; and means for introducing compressed air from the air supply chamber into the combustion chamber and for expelling exhaust gas from the combustion chamber as the piston approaches the lower deadpoint;

wherein the fuel injection means comprises a longitudinal fuel passage formed at the solid mounting portion of the fixed shaft and connected to a fuel supply line, a diametrically opposite pair of transverse fuel passages formed at the mounting portion and branching from the longitudinal passage to open into the combustion chamber, and valve means for controlling the fuel flow through the longitudinal and transverse fuel passages; and wherein the valve means comprises a pair of needle valves respectively accommodated in the transverse fuel passages to define a fuel passage gap, each needle valve being movable within a small range allowed by the fuel passage gap.

18. The engine according to claim 17, wherein each needle valve has an intermediate annular flange which is formed with a plurality of fuel passage grooves.

19. The engine according to claim 17, wherein the valve means further comprises a pressure sensitive valve slidably disposed on the mounting portion of the fixed shaft in alignment with the longitudinal fuel passage and normally urged by a spring to close the longitudinal fuel passage relative to the transverse fuel passages, the pressure sensitive valve being opening against the spring when the fuel pressure within the longitudinal fuel passage exceeds a preset value.

20. The engine according to claim 19, wherein the preset value for the fuel passage is variable by an adjuster.

* * * * *